US008147088B2

(12) United States Patent
Chen et al.

(10) Patent No.: US 8,147,088 B2
(45) Date of Patent: Apr. 3, 2012

(54) FOCUSING-TYPE FLASHLIGHT STRUCTURE

(76) Inventors: Yu-Liang Chen, Taichung (TW); Tang-Fang Lai, Taichung (TW)

( * ) Notice: Subject to any disclaimer, the term of this patent is extended or adjusted under 35 U.S.C. 154(b) by 323 days.

(21) Appl. No.: 12/379,896

(22) Filed: Mar. 4, 2009

(65) Prior Publication Data

US 2010/0182778 A1 Jul. 22, 2010

(30) Foreign Application Priority Data

Jan. 16, 2009 (TW) ..... 98200864 U

(51) Int. Cl.
*F21L 4/04* (2006.01)

(52) U.S. Cl. ..... 362/187; 362/205

(58) Field of Classification Search ..... 362/187, 362/202, 206, 208, 205, 188
See application file for complete search history.

(56) References Cited

U.S. PATENT DOCUMENTS

| | | | | |
|---|---|---|---|---|
| 4,774,664 | A * | 9/1988 | Campbell et al. | 705/38 |
| 4,807,097 | A * | 2/1989 | Gammache | 362/202 |
| 6,474,834 | B2 * | 11/2002 | Lai | 362/206 |
| 6,957,907 | B2 * | 10/2005 | Fischer et al. | 362/573 |
| 7,152,995 | B2 * | 12/2006 | Chapman | 362/206 |
| 7,824,062 | B2 * | 11/2010 | Ho | 362/188 |
| 7,850,330 | B2 * | 12/2010 | Spartano et al. | 362/194 |

* cited by examiner

*Primary Examiner* — Peggy A. Neils
(74) *Attorney, Agent, or Firm* — Raymond Y. Chan; David and Raymond Patent Firm

(57) ABSTRACT

A focusing-type flashlight structure includes a hollow cylinder body for accommodating the power supply component and screwed with an exterior cap having the switch device at the rear side and having a buckle channel and a protrusion stop ring and forming the diameter expansion section; a light emitting device positioned between the buckle channel and the protrusion stop ring of the hollow cylinder body; a light transparent cover for sealing the front side of the hollow cylinder body and having a protrusion hook for clasping with the buckle channel to achieve the positioning; and a zooming device including a hollow tube having a first, second, and third ring section with converged diameters from the front to the rear in order, and a lens disposed between the first ring section of the hollow tube, and a light opening cover to achieve the positioning.

7 Claims, 4 Drawing Sheets

FOCUSING-TYPE FLASHLIGHT STRUCTURE

FIELD OF THE INVENTION

The present invention relates to a focusing-type flashlight structure, and more particularly to the focusing-type flashlight structure that adopts the straight light shift to adjust the various focuses.

BACKGROUND OF THE INVENTION

According to the publication patent, DE 2002006014503 shows "a rapid zooming device for LED (light emitting diode) includes: a main body equipped with a power device; a LED connected to the power device to enable the LED to be fastened in the front inside of the main body; and a convex lens disposed to the front of the LED. The convex lens can move relative to the LED. The distance change provided by the LED relative to the convex lens within the double focus of the convex lens."

The foregoing structure further defines that the distance provided by the convex lens relative to the LED is at the range between 0 mm and 32 mm. However, the drawbacks are that the interior front side of the main body needs to be processed with interior threading and the fastening base of the light emitting element shown in the patent application also needs to be processed with exterior threading. Moreover, since many parts disposed to the front side of the light emitting element are not labeled to mark numbers for illustration, the shortcomings of many parts, complicated processing procedure, and high manufacture cost are caused.

Accordingly, to overcome the foregoing shortcomings, the inventor(s) of the present invention based on years of experience in the related field to conduct extensive researches and experiments, and finally invented a novel utility structure.

SUMMARY OF THE INVENTION

The objective of the present invention is to provide a focusing-type flashlight structure with simple structure and easy assembly.

To achieve the foregoing objective, the focusing-type flashlight structure of the present invention includes a hollow cylinder body, a light emitting device, a light transparent cover and a zooming device.

The inside of the hollow cylinder body can accommodate a battery. The rear side of the hollow cylinder body has a screw hole for screwing with an exterior cap having an exterior threaded. A switch device is disposed to an axial direction of the exterior cap, and provided for pressing from the exterior to control the electric conduction. The interior front side of the hollow cylinder body has a buckle channel and a protrusion stop ring. The exterior front side of the hollow cylinder body forms a diameter expansion section. A circular concave groove is located at the rear side of the diameter expansion section. An O-ring is disposed in the circular concave channel.

The light emitting device is disposed between the buckle channel and the protrusion stop ring of the hollow cylinder body, and includes a light emitting element disposed to the front side of a circuit board. The circuit board is combined with a heat dissipation base to form a whole. A reflective plate is further put to the front side of the light emitting element. The light emitting element passes through a center hole disposed to the reflective plate to protrude at the front side of the reflective plate.

The light transparent cover seals the front side of the hollow cylinder body. The exterior front side of the light transparent cover forms a limiting groove for accommodating a water stop ring. The rear side of the light transparent cover has a protrusion hook for clasping with the buckle channel to achieve the positioning.

The zooming device includes a hollow tube that has a first ring section, a second ring section and a third ring section with converged diameters from the front to the rear in order. The front side of the first ring section forms an interior threaded section that is screwed with a light opening cover. The second ring section is provided for accommodating the diameter expansion section of the hollow cylinder body. The third ring section can be put to the exterior portion of the hollow cylinder body. The zooming device also includes a lens that is put between the first ring section of the hollow tube and the light opening cover to achieve the positioning.

Upon the assembly of the foregoing components, it does not only achieve the function of changing the distance between the light transparent cover and the lens, but also simplifies the conventional structure parts and changes the state of assembling the conventional structure parts to achieve the improvement effect of convenient assembly procedure while shifting the hollow tube at a straight-line.

Other features and advantages of the present invention and variations thereof will become apparent from the following description, drawings, and claims.

DETAILED DESCRIPTION OF THE PREFERRED EMBODIMENTS

The present invention will be apparent from the following detailed description, which proceeds with reference to the accompanying drawings, wherein the same references relate to the same elements.

Figure 1:
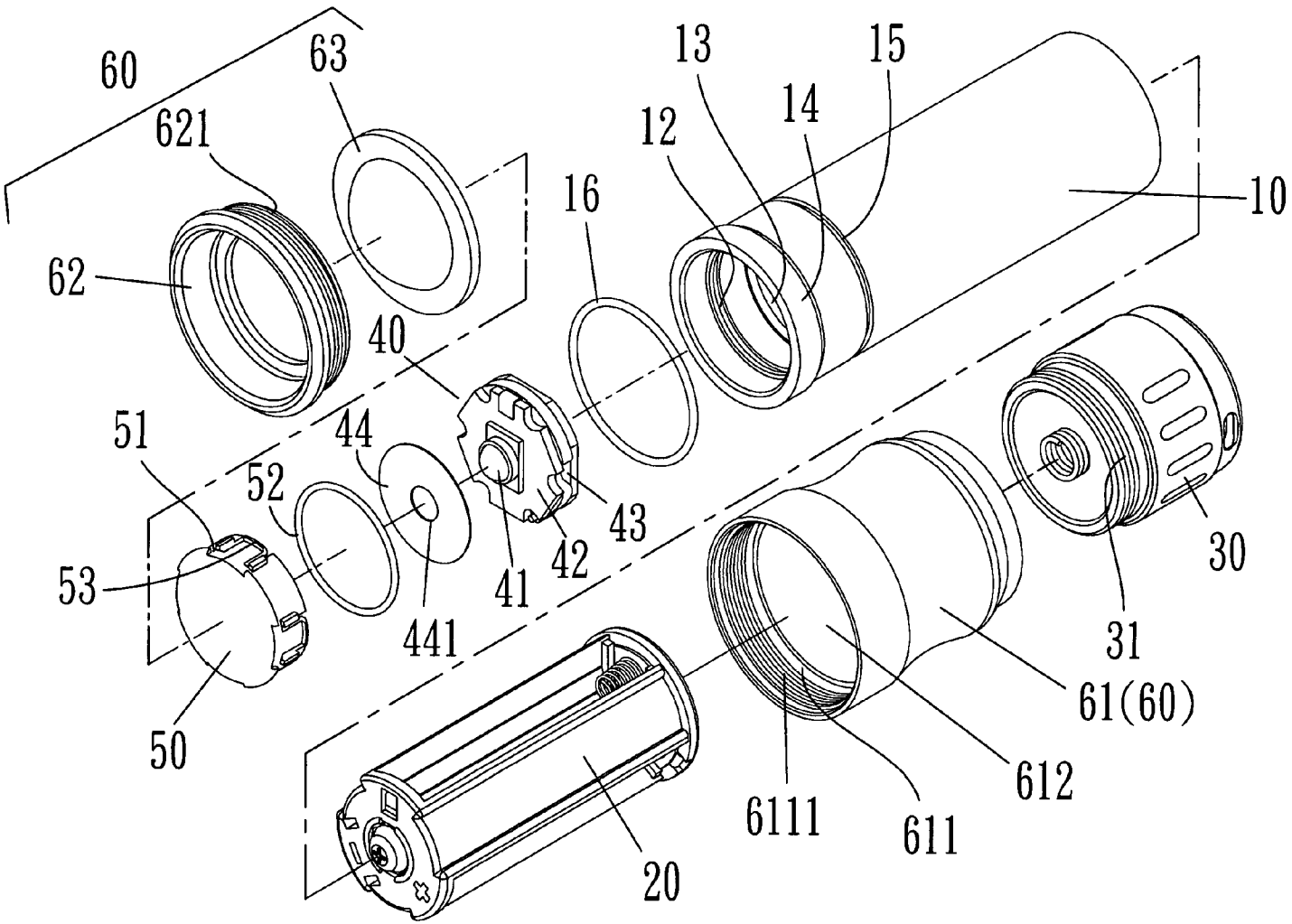
FIG. 1 is a decomposition chart of the structure according to a preferred embodiment of the present invention.
Figure 2:
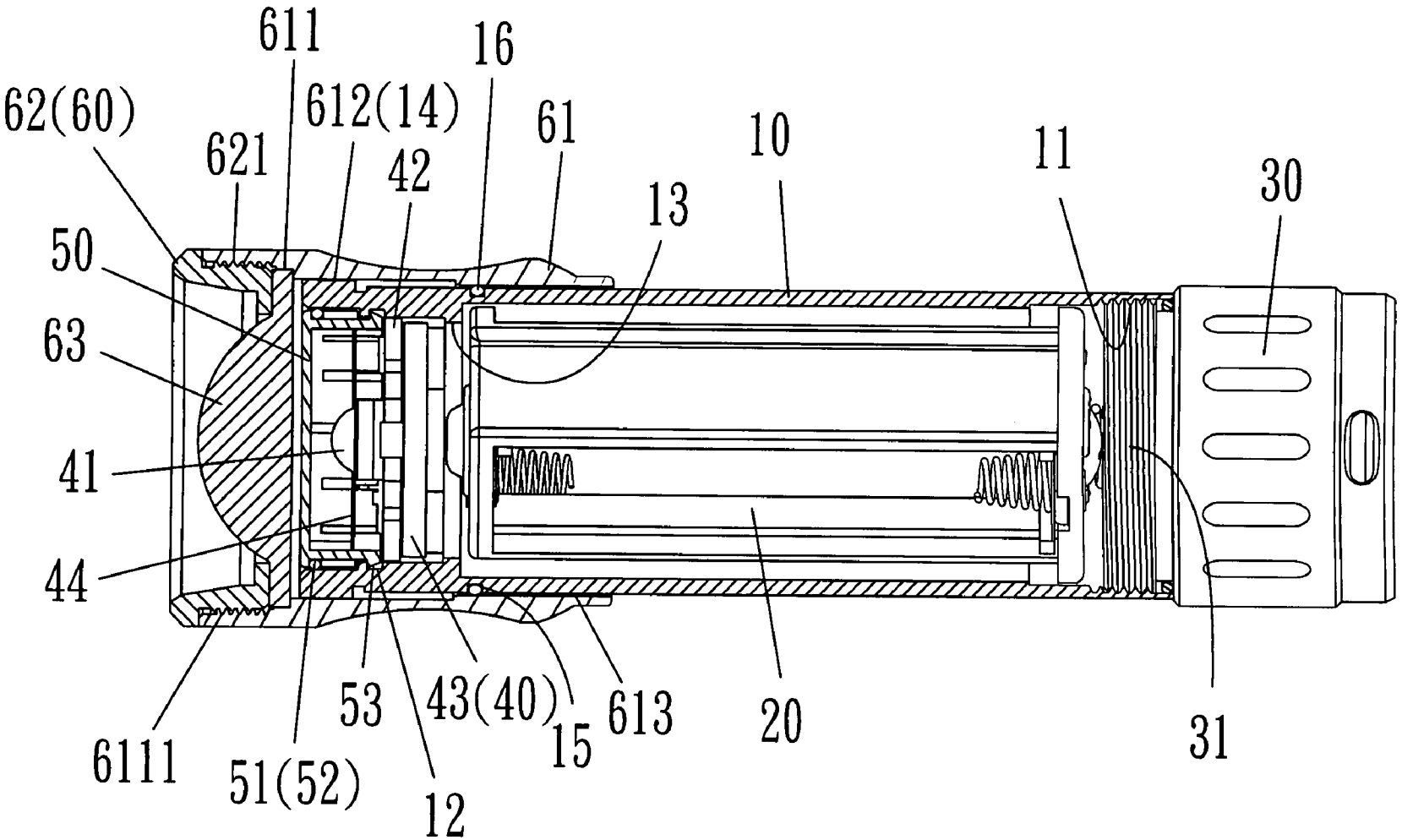
FIG. 2 is a cross-sectional drawing of the structure assembly according to a preferred embodiment of the present invention.
Figure 3:
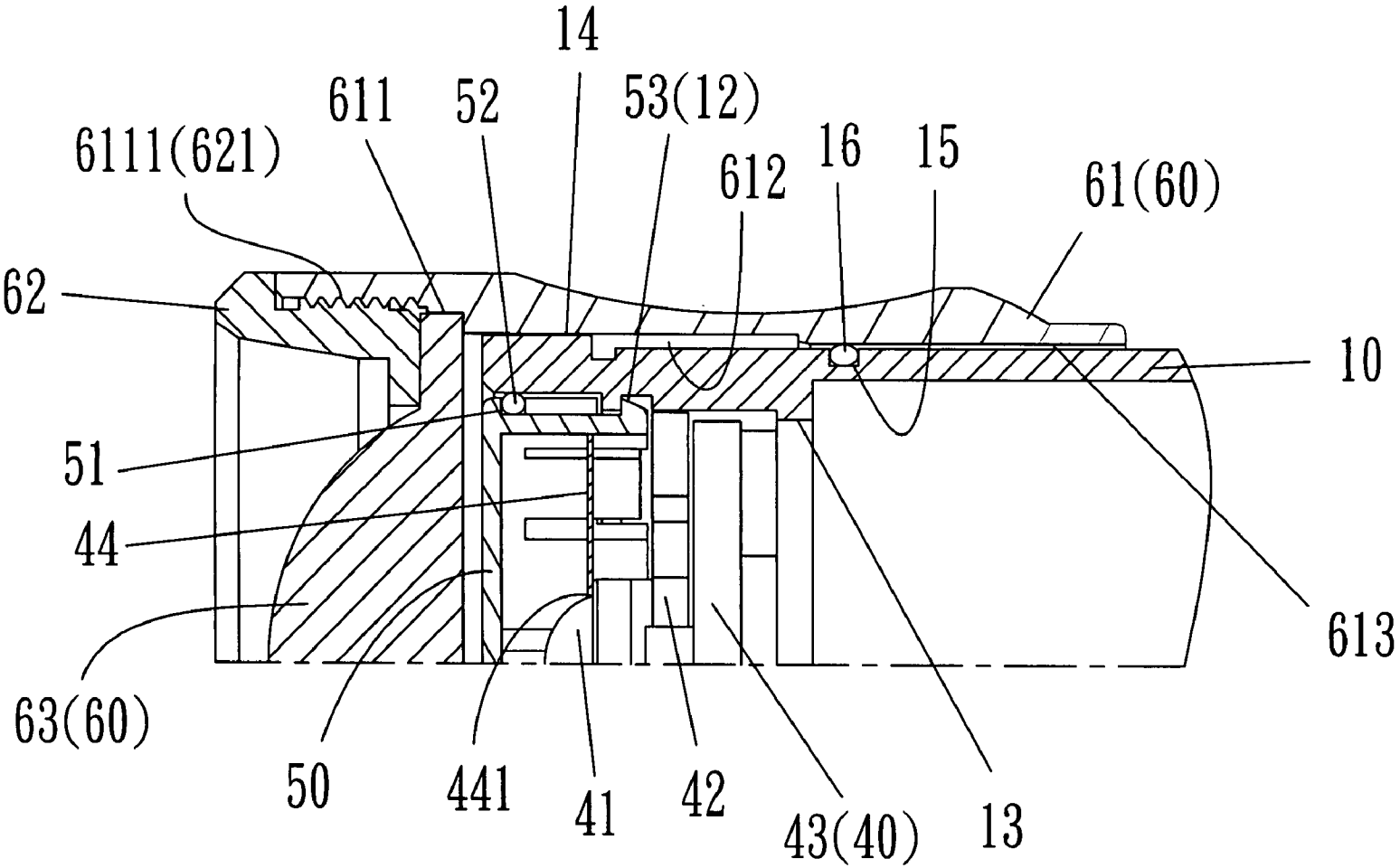
FIG. 3 is a partial enlarged drawing according to FIG. 2.
Figure 4:
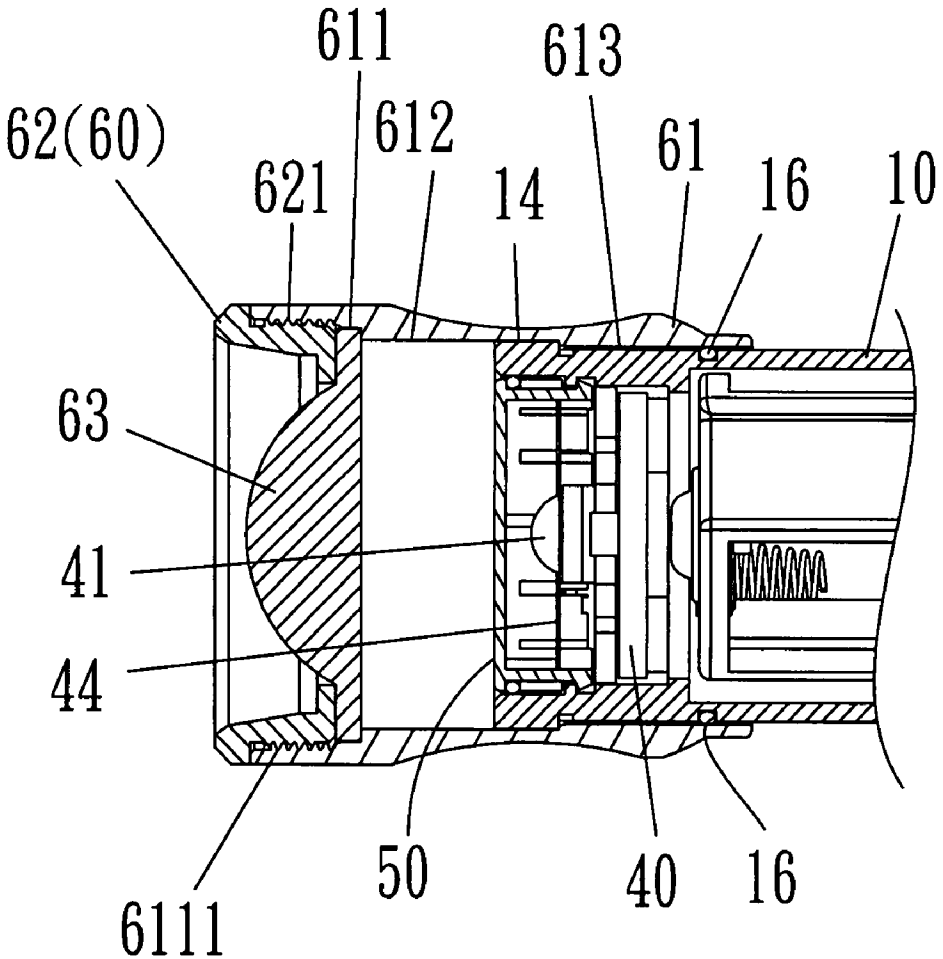
FIG. 4 is an operation drawing of the structure according to a preferred embodiment of the present invention.

Please referring FIG. 1 to FIG. 4, a focusing-type flashlight structure is shown according to a preferred embodiment of the present invention. The structure includes a hollow cylindrical body 10, which is also known as hollow cylinder body 10, for accommodating a power supply component 20. The power supply component 20 shown in the embodiment is a battery box for containing a plurality of batteries. The rear side of the hollow cylindrical body 10 has a screw hole 11 for screwing with an exterior cap 30 having an exterior threaded 31. The inside of the exterior cap 30 has a power switch device. The power switch device is pressed from the outside to control the electric conduction (since the power switch device of the exterior cap 30 is a conventional structure and is not the technical improvement of the present invention, there is no need to illustrate in detail). The front inside of the hollow cylindrical body 10 has a light emitting device 40 and a light transparent cover 50. A zooming device 60 is put to the front exterior of the hollow cylindrical body 10. By using the foregoing components, the entire structure is assembled.

A buckle channel 12 and a protrusion stop ring 13 are sequentially disposed to the interior front side of the hollow cylindrical body 10. A diameter expansion section 14 is formed at the exterior front side of the hollow cylinder body 14. A circular concave groove 15 is located at the rear of the diameter expansion section 14. An O-ring 16 is accommodated in the circular concave groove 15.

The light emitting device 40 is disposed and positioned between the buckle channel 12 and the protrusion stop ring 13 of the hollow cylindrical body 10, and includes a light emitting element 41 disposed to the front side of a circuit board 42. The circuit board 42 is combined with a heat dissipation base 43 to form a whole. A reflective plate 44 is put to the front side of the light emitting element 41. The light emitting element 41 passes through a center hole 441 disposed to the reflective plate 44 to protrude at the front side of the reflective plate 44. The exterior edge of the heat dissipation base 43 can lean against a side of the protrusion stop ring 13. A side of the light transparent cover 50 can lean against the exterior surface of the circuit board 42.

The light transparent cover 50 can seal the front side of the hollow cylindrical body 10. The exterior front side of the light transparent cover 50 forms a limiting groove 51. A water stop ring 52 is accommodated in the limiting groove 51. The rear side of the light transparent cover 50 has a protrusion hook 53 for clasping with the buckle channel 12 of the hollow cylindrical body 10 to achieve the positioning. After the light transparent cover 50 is fastened to the front exterior of the hollow cylindrical body 10, the exterior edge of the water stop ring 52 can lean against the inner wall of the front side of the hollow cylindrcal body 10 to have the waterproof function between the hollow cylindrical body 10 and the light transparent cover 50.

The zooming device 60 includes a hollow tube 61 and a lens 63. The hollow tube 61 can cover the front side of the hollow cylindrical body 10 to perform the shift adjustment of straight line at the proper distance. The hollow tube 61 has a first ring section 611, a second ring section 612 and a third ring section 613 with converged diameters from the front to the rear in order. The front side of the first ring section 611 forms an interior threaded section 6111 and is screwed with a light opening cover 62 having an exterior threaded section 621. The second ring section 612 can be provided for accommodating the diameter expansion section 14 of the hollow cylindrical body 10. The third ring section 613 can be put to the exterior portion of the hollow cylindrical body 10. The lens 63 is put between the first ring section 611 of the hollow cylinder body 61 and the light opening cover 62 to achieve the positioning. The lens 63 shown in the embodiment adopts a convex lens that is illustrated in detail. One side surface of the lens can lean against the intersection surface of the first ring section 611 and the second ring section 612 where another side surface can leans against the relative surface of the light opening cover 62.

Upon the assembly of the foregoing components, the hollow tube 61 of the zooming device 60 can be shifted via the straight line to change the focus length between the lens 63 and the light emitting element 41 of the light emitting device 40. When the hollow tube 61 continuously shifts toward the light extraction direction, the side edge of the diameter expansion section 14 of the hollow cylindrical body 10 can be fitted and stopped at the intersection surface between the second ring section 612 and the third ring section 613 of the hollow tube 61 to prevent the hollow tube 61 from coming off the hollow cylindrical body 10.

Each component structure, the position and the assembly manner of the focusing-type flashlight structure of the present invention are illustrated as the foregoing paragraphs. The practical effect and the features achieved by the present invention are further illustrated as the following:

Since the interior front side of the hollow tube of the present invention is directly equipped with a buckle channel and a protrusion stop ring, the protrusion stop ring can be utilized to perform the limiting function directly after the light emitting device is assembled to the interior front side of the hollow tube. Subsequently, the protrusion hook of the light transparent cover fastened and inserted to the buckle channel can be continuously executed. The structure shape is unlike the conventional screwing manner that consumes time and has inconvenience. The assembly convenience of the present invention is therefore improved.

Moreover, since a water stop ring is put between the inside of the hollow tube and the light transparent cover and an O-ring is disposed between the hollow tube of the zooming device and the exterior portion of the hollow cylinder body, the waterproof effect provided by the front section of the focusing-type flashlight structure can be achieved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A focusing-type flashlight structure comprising: a hollow cylindrical body threaded with an exterior cap having a switch device at a rear side and sheathed with a zooming device at a front side, the characterized in that: an interior front side of the hollow cylindrical body having a buckle channel and a protrusion stop ring, an exterior front side of the hollow cylindrical body having a diameter expansion section; a light emitting device disposed and positioned between the buckle channel and the protrusion stop ring of the hollow cylindrical body; a light transparent cover for sealing the interior front side of the hollow cylindrical body and having a protrusion hook for clasping with the buckle channel at a rear side of the light transparent cover to secure into position, wherein the zooming device comprises a hollow tube having a first ring section, a second ring section and a third ring section with converged diameters from the front to the rear in order, and a light opening cover is threaded with a front of the first ring section, and a lens is positioned between the first ring section of the hollow tube and the light opening cover, and the second ring section is accommodated to the diameter expansion section of the hollow cylindrical body, and the third ring section is disposed to the exterior portion of the hollow cylindrical body.

2. The focusing-type flashlight structure as claimed in claim 1, wherein the hollow cylindrical body has a circular concave groove disposed at a rear of the diameter expansion section, and an O-ring is disposed within the circular concave groove for leaning against the zooming device.

3. The focusing-type flashlight structure as claimed in claim 1, wherein an exterior front side of the light transparent cover has a limiting groove, and a water stop ring disposed in the limiting groove and leans against an interior wall of the hollow cylindrical body.

4. The focusing-type flashlight structure as claimed in claim 1, wherein the light emitting device includes a light emitting element disposed on a front side of a circuit board, and the circuit board is combined with a heat dissipation base, and a reflective plate is disposed to a front side of the light emitting element, and the light emitting element passes through a center hole disposed to the reflective plate to protrude at a front side of the reflective plate.

5. The focusing-type flashlight structure as claimed in claim 4, wherein an exterior edge of the heat dissipation base leans against a side of the protrusion stop ring of the hollow cylindrical body, and a side of the light transparent cover leans against the exterior surface of the circuit board.

6. The focusing-type flashlight structure as claimed in claim 1, wherein the diameter expansion section has a rear side having a circular concave groove wherein an O-ring is disposed within said circular concave groove, wherein the light transparent cover is arranged for forming a limiting groove for accommodating a water stop ring at an exterior front side of the light transparent cover.

7. The focusing-type flashlight structure as claimed in claim 6, wherein the light emitting device comprises a light emitting element disposed on a front side of the circuit board, and the circuit board is assembled to a heat dissipation base, and a reflective plate is positioned at a front side of the light emitting element, and the light emitting element passes through a center hole disposed in the reflective plate to protrude at a front side of the reflective plate.

* * * * *